United States Patent [19]

Wu

[11] Patent Number: 4,948,361

[45] Date of Patent: Aug. 14, 1990

[54] PORTABLE AMUSEMENT LIGHTER

[76] Inventor: Matthew Wu, 1F., No. 10-3, Lane 180, Tzu Cheang St., Pei Tou District, Taipei, Taiwan, R.O.C.

[21] Appl. No.: 440,182

[22] Filed: Nov. 22, 1989

[51] Int. Cl.[5] ..... F23Q 3/00

[52] U.S. Cl. ..... 431/125; 431/255; 431/253

[58] Field of Search ..... 431/125, 255, 253

[56] References Cited

U.S. PATENT DOCUMENTS 3,741,714 6/1973 Yoshinaga ..... 431/255

3,817,692 6/1974 Retzler ..... 431/255

*Primary Examiner*—Carroll B. Dority

*Attorney, Agent, or Firm*—Varndell Legal Group

[57] ABSTRACT

A portable amusement lighter, which is to set a gas control propeller inside a lighter casing so as to let the gas control propeller be controlled by a driving control crank for fire striking. When the driving control crank is operated, three face wheels will be driven to rapidly rotate, by means of gears through a gear driving means, so as to provide a special amusing effect while a fire is struck. The present invention is to provide a portable amusement lighter, which is attractive in design and is practical for amusement as well as for making a fire.

1 Claim, 2 Drawing Sheets

PORTABLE AMUSEMENT LIGHTER

BACKGROUND AND SUMMARY OF THE INVENTION

In order to attract consumers to buy, lighter manufacturers are doing their best to provide a variety of lighters in a variety of unique designs, for example, pistol-like lighter or lighter watch, etc. However, the improvements in function or configuration still provides little amusing effect. For lighter watch, as an example, it is just to combine a lighter and a watch together, which has nothing special in design.

The main object of the present invention is to provide a portable amusement lighter which serves as an amusement machine and a lighter concomitantly.

The other object of the present invention is to provide a portable amusement lighter which includes a driving control crank to let fire striking become more easier.

The above and other objects and features of the present invention will become more apparent from the following detailed description in connection with the annexed drawings as hereunder.

DETAILED DESCRIPTION OF THE PREFERRED EMBODIMENT

Figure 1:
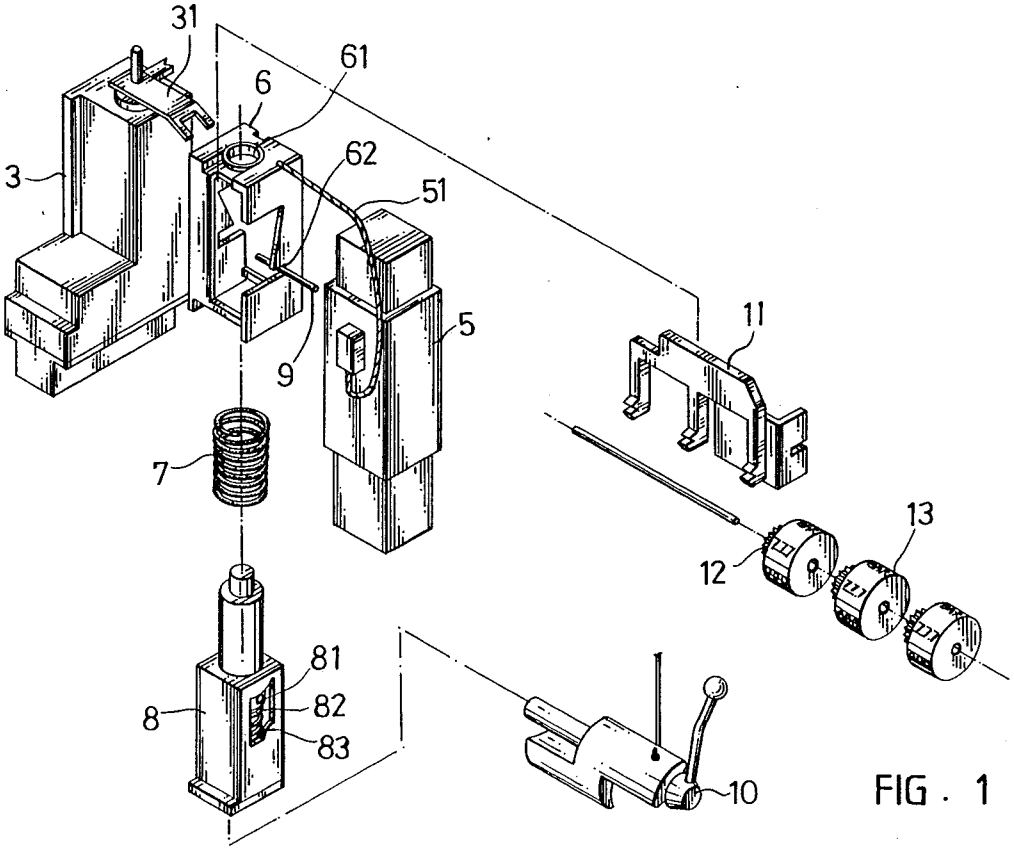
FIG. 1 is a fragmentary perspective view of the present invention.
Figure 3:
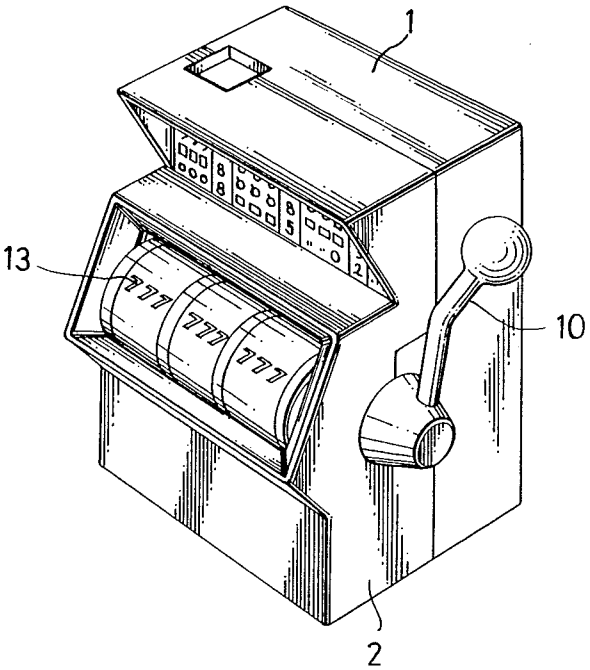
FIG. 3 is a schematic drawing illustrating the outer appearance of the present invention.
Figure 2:
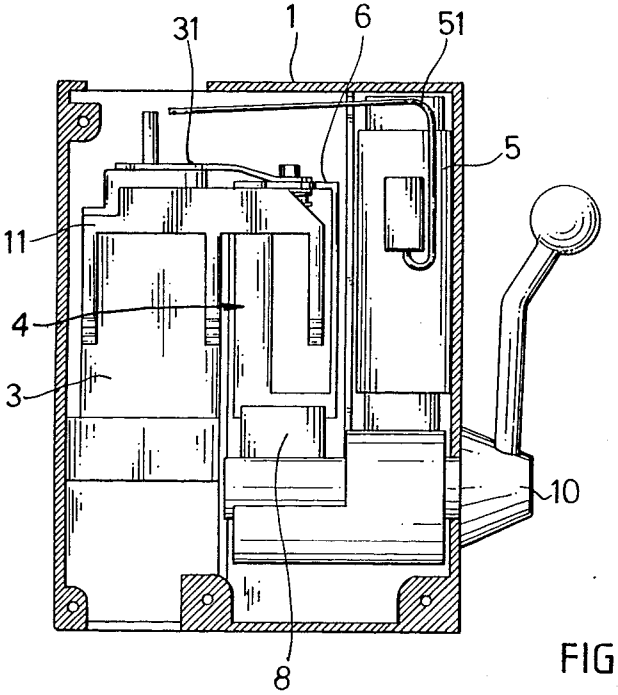
FIG. 2 is a perspective sectional view of the present invention.

Referring to FIGS. 1 and 3, an amusement lighter includes a lower casing 1 having therein a gas storage cylinder 3 having a gas discharge valve set at the left side, with a gas control propeller 4 set at its right side; a fire striking means 5 set at the right side. The gas control propeller 4 is comprised of a body 6, a spring 7, and a support rod means 8. The spring 7 is set inside the body 6. When the support rod means 8 is inserted into the body 6 through the spring 7 to protrude beyond the center core 61 of the body 6, a pin rod 62 is provided through the body 6 and a slot 81 to let the body 6, the spring 7 and the support rod 8 be firmly connnected into one unit. When the crank 10 is operated, the fire striking means 5 will produce a spark at the end of wire 51, and the support rod 8 will be simultaneously driven to move upward to push the leaf spring 31 to operate the gas discharge valve so as to let gas be discharged out of the gas storage cylinder 3. As shown in FIG. 1, when the support rod means 8 is driven to move upward, its inner spring 82 will store energy, and its inner flange 83 will drive the pin rod 9 to break away from the notch 62 of the body 6, so as to let the spring 82 of the support rod means 8 give a stroke and push a gear driving means 11 to move upward, to further drive the gears 12 to rotate. Therefore, the respective face wheels 13 will be simultaneously driven by the gears 12 to rapidly rotate.

At this moment, the rotation of the face wheels 13 is visible from the outside through the upper casing 2. The upper casing 2 includes a panel to display a payout for the figures presented on the face wheels 13 when the face wheels 13 are stopped, that is, the amusement lighter provides an effect the same as a slot machine, and the rapid rotation of the face wheels 13 provides the player with a dynamic feeling. As soon as the crank 10 is released, the spring 7 will provide a spring force to drive all component parts to return to the original normal position and, to let the gas storage cylinder valve be closed.

I claim:

1. A portable amusement lighter, including a gas storage cylinder having a gas discharge valve and a lever for controlling said valve, a gas controller propeller means including a pin rod, a spark producing means, a plurality of face wheels each having a gear and means for driving said gears, means including a driving control crank to operate said gas control propeller means to open said valve by means of said lever, to operate said gear driving means by said pin rod and to operate said spark producing means.

* * * * *